US007681808B2

(12) United States Patent
Shimada

(10) Patent No.: US 7,681,808 B2
(45) Date of Patent: Mar. 23, 2010

(54) SPRAY DEVICE FOR SMALL AMOUNT OF LIQUID

(75) Inventor: Takaji Shimada, Saitama (JP)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 12/177,429

(22) Filed: Jul. 22, 2008

(65) Prior Publication Data

US 2009/0026291 A1 Jan. 29, 2009

(30) Foreign Application Priority Data

Jul. 24, 2007 (JP) ..... 2007-214144

(51) Int. Cl.

| | |
|---|---|
| ***B05B 7/00*** | (2006.01) |
| ***B05B 7/10*** | (2006.01) |
| ***B05B 7/12*** | (2006.01) |
| ***B05B 7/06*** | (2006.01) |
| ***B05C 5/00*** | (2006.01) |

(52) U.S. Cl. ..... 239/296; 239/405; 239/406; 239/422; 239/424; 118/300

(58) Field of Classification Search ..... 239/290, 239/296, 398, 399–401, 403, 405, 406, 418, 239/422, 423, 424, 424.5, 428, 463; 118/300, 118/317, 320

See application file for complete search history.

(56) References Cited

U.S. PATENT DOCUMENTS

| | | | | | |
|---|---|---|---|---|---|
| 4,785,996 | A * | 11/1988 | Ziecker et al. | ..... | 239/298 |
| 5,800,867 | A * | 9/1998 | Matsunaga et al. | ..... | 427/476 |
| 6,149,076 | A * | 11/2000 | Riney | ..... | 239/135 |
| 6,745,948 | B1 * | 6/2004 | Hidaka et al. | ..... | 239/8 |

FOREIGN PATENT DOCUMENTS

JP 2004089976 A 3/2004

OTHER PUBLICATIONS

Nordson Corporation, Swirl Fine Spray Gun, Dec. 2006, 2 pgs.

* cited by examiner

*Primary Examiner*—Darren W Gorman
(74) *Attorney, Agent, or Firm*—Wood, Herron & Evans, L.L.P.

(57) ABSTRACT

A spray device includes an opening gap between a needle-shaped needle tip and a first nozzle hole. The gap is adjusted by a very tiny amount by a needle movement amount adjustment device, and liquid oozes from the first nozzle hole along the needle tip part. The liquid is formed into tiny particles by a first atomization compressed gas flowing through the first atomization compressed gas passage and is exhausted from a second nozzle hole. The exhaust flow passes through a third nozzle hole and is exhausted. The third nozzle's second atomization/eddy flow formation compressed gas collides with this exhaust flow, so the exhaust flow is made into even smaller particles, and swirls and disperses, and is applied to the coated object.

3 Claims, 5 Drawing Sheets

SPRAY DEVICE FOR SMALL AMOUNT OF LIQUID

The present application claims the priority of Japanese Patent Application No. 2007-214144 filed Jul. 24, 2007 under 35 U.S.C. §119. The disclosure of that priority application is hereby fully incorporated by reference herein.

TECHNICAL FIELD

The present invention relates to a spray device or spray gun for atomizing a liquid such as a liquid photoresist agent, surface protection film, functional coating agent, etc., in an extremely fine manner and applying it to an object such as a semiconductor silicon wafer, glass substrate, various types of resins, metal members, etc., to form a thin film.

BACKGROUND

When forming a film of a photoresist agent or functional film whose dry film thickness is 10 μm or less on a semiconductor silicon wafer or glass substrate, application technologies such as spin coaters or bar coaters, etc. have generally been used. This works well with a semiconductor silicon wafer or glass substrate which is flat, or when the surface to which the resist agent is applied is planar, but when the surface is uneven, and not flat, and application is made with a spin coater, the coating material may fly off when performing the necessary rotation of the coated object. Also, it is difficult to form a film with a spin coater or bar coater, etc., on a spherical object or a cylindrical object, which have shapes that cannot be rotated. Also, if the coated surface is uneven (i.e., the surface has a large aspect ratio) or has depressions or holes, it is not possible to coat the uneven part or the sides and bottoms of depressions or the sides of holes, etc.

Therefore, methods have been studied for forming a film of a coating material using a spray gun, but to obtain a film whose dry thickness is 10 μm or less the particle diameter of the atomized liquid is generally about 10 μm to 20 μm, so there are undulations in the coating film, variation in film thickness, bubbles, etc. are attached, considerable time is required to determine the coating condition settings, and it is difficult to obtain a film thickness with good precision. When spraying is performed using an ordinary air spray gun, the particle diameter of the coating material is generally about 10 μm to 15 μm even if viscosity is reduced to 20 CPS or lower.

In that case, when adhering and accumulating coating particles at the uneven part of a 20 μm stepped area, the particle diameter is large, so the coating material sags at the corner of the recessed part and becomes too thin. If one attempts to make the particle diameter finer, such as 10 μm or smaller, a film cannot be formed unless the atomization air pressure increases to 0.4 MPa or higher and the amount dispensed is reduced. In this case, the atomization air pressure is too strong, and the particles that are 10 μm or smaller adhere to the coated object unevenly, and the coating efficiency falls to 30% or less, and it is not successful as an application device. If the usual dry film thickness is 10 μm in an ordinary flat-surface coating, the film thickness precision of a spray is ±10% or more.

When forming a film as thin as 10 μm or less, an air atomization spray is generally the most inexpensive spray system. There are also spray guns which can perform atomization using an ultrasonic atomization system, but the spray speed is too slow, and in practice adhesion to the coated object is uneven, so they are generally used in humidifiers, etc. Also, in airless spray systems and centrifugal atomization systems the viscosity of the liquid is reduced to 20 CPS or lower to form particles of 10 μm and smaller, but they have the defect that at a location 300 mm or farther from the spray exhaust exit only about 20% of the entire dispensed amount is formed, and in addition they are not suitable for low dispensing amounts in which 30 cc or less is applied to the coated object each minute. Therefore, it is customary to consider a two-fluid spray system using air atomization when forming a film as thin as 10 μm or less. However, as described above, the biggest disadvantage is that the coating efficiency is extremely low—about 20-30%—and it has not been possible to achieve a coating film thickness precision of ±5% or less, as with a spin coater, in the film thickness region of 10 μm or less.

Accordingly, using a spray system known as an air brush, which is a special spray system, has also been considered as an air spray. An air brush is a system which utilizes a small hand-held spray gun that is often used when coating plastic components or small products. Its nozzle aperture is 0.5 mm ϕ or less, and the needle used in coating material exhaust control has a needle shape. When a coating material adheres to and flows out along the needle-shaped needle, the surrounding compressed air atomizes the coating material by the ejector effect. The dispensed amount can be limited to 5 cc or less each minute, and it is possible to form tiny particles of 10 μm or smaller even when the spray nozzle is as close as about 10 mm, so it is possible to coat the coated object with a high efficiency of 80% or higher because the spray nozzle is close.

On the other hand, a liquid two-stage atomization system like that disclosed in Japanese Patent Document JP 2004-89976A, for example, is known as a system for making tiny particles and applying them using an air spray system. In this atomization method, in the first stage a liquid is atomized by compressed air, and in the second stage swirling air acts on the liquid exhaust flow and additionally promotes atomization, and coating is performed as a swirling exhaust flow.

A spray system using the above-described air brush has difficulty controlling small amounts or very small amounts dispensed. That is, adjusting the amount dispensed is a system in which the needle's stroke is increased or decreased by a manual operation, and so it has the problem that quantitative control and adjustment require considerable skill, and therefore automated coating is difficult. In addition, this spray system has the problem that the applied pattern width is narrow: about 5 mm.

Also, the particle-making/application device disclosed in Japanese Patent Document JP 2004-89976A has the advantage that the atomized pattern is wider than in an air brush system, but it has the problem that performing an adjustment to supply tiny amounts of liquid is difficult.

The present invention seeks to solve the problems of the conventional liquid spray devices described above. Its object is to provide a spray device for a small amount of liquid that forms tiny particles of liquid or molten material at the same level or higher than the ultra-tiny particles formed by ultrasonic atomization or an air brush spray system, and that can easily and reliably adjust the supply of liquid to a desired small amount or a very small amount, and that can perform coating of and adhesion to a coated object efficiently, and that can form a uniform and thin film of a liquid such as a liquid photoresist agent, surface protection film, functional coating agent, etc., on a coated object such as a semiconductor silicon wafer, glass substrate, various transparent members, etc., by spray coating.

SUMMARY

The present invention provides a spray device for making a small amount of liquid into tiny particles and applying them to an object. The spray device comprises a liquid supply passage, an extremely slender needle with a needle-shaped tip part that is long and slender and tapering. A first nozzle constitutes a valve mechanism with the tip part of the needle, and has an extremely narrow first nozzle hole with a shape that corresponds to the needle tip part. The needle tip part can insertably fit into the first nozzle hole. A second nozzle surrounds the periphery of the first nozzle and forms a ring-shaped first atomization compressed gas passage with the first nozzle. The second nozzle has a small-diameter second nozzle hole formed at its lower end. A third nozzle, at the lower end of the second nozzle, includes a third nozzle hole formed so as to surround the second nozzle hole of the second nozzle, with a plurality of compressed gas supply passages for second atomization/eddy flow formation formed at the periphery of the third nozzle hole. A needle movement amount adjustment device is provided so that it can touch the rear end of the needle, and can make extremely tiny adjustments of the opening gap of the needle-shaped needle tip part and the first nozzle hole of the first nozzle. When dispensing liquid, liquid oozes from the first nozzle hole of the first nozzle along the needle tip part, and the liquid is made into tiny particles by the first atomization compressed gas flowing through the first atomization compressed gas passage and is exhausted from the second nozzle hole of the second nozzle. The exhaust flow then passes through the third nozzle hole of the third nozzle and is exhausted, and the second atomization/eddy flow formation compressed gas collides with the exhaust flow, so the exhaust flow is made into even smaller particles, and swirls and disperses, and is applied to the coated object.

As a result, the opening gap between the needle-shaped needle tip part and the first nozzle hole can be adjusted by a very small amount by the needle movement amount adjustment device when dispensing liquid. Liquid oozes from the first nozzle hole and along the needle tip part, and the liquid is made into tiny particles by the first atomization compressed gas flowing through the first atomization compressed gas passage and is exhausted from the second nozzle hole, and the exhaust flow passes through the third nozzle hole and is exhausted, and the third nozzle's second atomization/eddy flow formation compressed gas collides with this exhaust flow, so the exhaust flow is made into even smaller particles, and swirls and disperses, and is applied to the coated object.

When adjusting the liquid dispensing amount, the opening gap amount between the needle-shaped needle tip part and the first nozzle hole can be adjusted by the needle movement amount adjustment device. When dispensing liquid, atomization may be performed by the first atomization compressed gas with the aperture adjustable by a unit of 8-15 μm, preferably a unit of 10 μm, for example, using the needle stroke length. Attaching a needle movement amount adjustment device that can adjust the stroke length of the needle by the 10 μm unit value given in this example ensures reproducibility of the dispensed amount each time the valve opens and closes, and produces stable dispensing.

In this case, it is possible to use a micro-adjust as the needle movement amount adjustment device. Therefore, controlling and adjusting the amount of liquid dispensed does not require increasing or decreasing the needle stroke through a manual operation which requires skill as in prior art, and quantitative dispensed amount control can be performed with good reproducibility, and automated coating can be performed.

Also, the spray device for a small amount of liquid described above is a spray device for a small amount of liquid which has the feature that the needle's needle-shaped tip part is positioned to project to the interior of the third nozzle hole of the third nozzle with the valve mechanism open. As a result, the dispensed liquid passes through the very small gap between the first nozzle hole and the needle tip part. This gap is a ring-shaped gap that becomes smaller toward the tip. The liquid oozes out along the very narrow needle tip part, and as a result a small amount of liquid is stably guided to the coated object in the downstream direction and dispensed.

Then the stable flow of that liquid is atomized and made into tiny particles by a negative pressure effect due to the surrounding first atomization compressed gas, which has a pressure of 0.1-0.3 MPa, for example, and is exhausted from the second nozzle hole, which has an opening diameter of 0.8-1.5 mm ϕ, for example. The exhaust flow additionally passes through the third nozzle hole, which has an opening diameter of 1.0-2.0 mm ϕ, and collides with and is dispersed by the second atomization/eddy flow formation compressed gas, which has a pressure of 0.1-0.3 MPa, for example, that is exhausted from the plurality of compressed gas supply passages of the third nozzle, thereby making the liquid into even tinier particles and dispersing the atomization pattern region.

Also, the spray device for a small amount of liquid described above is a spray device for a small amount of liquid which has the feature that the viscosity of the liquid supplied to the liquid supply passages has a low viscosity of 10-100 CPS, the exit opening diameter of the first nozzle hole of the first nozzle is 0.2-0.6 mm, the angle of the needle-shaped needle tip part is 3°-10°, the opening inner diameter of the second nozzle hole of the second nozzle is 0.8-1.5 mm, and the opening diameter of the third nozzle hole of the third nozzle is 1.0-2.0 mm. The movement distance for performing very tiny amount adjustments of the opening gap between the needle-shaped needle tip part and the first nozzle's first nozzle hole by the needle movement amount adjustment device can be adjusted to each 8-15 μm (microns), and the liquid dispensing amount can be set at 0.1-10 $cm^3$/min, thereby making small amounts of liquid into tiny particles and applying them.

As a result, it is possible to apply a small amount of liquid with good efficiency and accuracy. That is, it is possible to achieve two-stage tiny particle making in which a liquid with low viscosity (10-100 CPS) and a dispensed amount of 0.1-10 $cm^3$/min is passed through the first through third nozzles and stably follows the needle tip part and is guided to a coated object that is downstream. The angle of the needle-shaped needle tip part is 3°-10°, preferably 4°-6°. If the needle's movement distance unit is smaller than 8 μm, the ring-shaped gap between the first nozzle hole and the needle tip part becomes too small in relation to the angle of the needle tip part, and fluid cannot pass through the gap with stability. If the unit is larger than 15 μm, the ring-shaped gap becomes too large, and making tiny particles stably becomes difficult.

Making the exit opening diameter of the first nozzle hole smaller makes it possible to constrict the dispensing flow rate, but if it is smaller than 0.2 mm clogging of the nozzle hole is likely to occur. Also, if it is larger than 0.6 mm, it is difficult to achieve the goal of making a liquid into tiny particles, especially when the discharge amount is a tiny amount such as 0.2-5.0 $cm^3$/min. In light of these points, the exit opening diameter of the first nozzle hole is more preferably 0.3-0.5 mm. If the second nozzle opening diameter is smaller than 0.8 mm, it is difficult to make tiny particles of the liquid using the first atomization compressed gas flow due to the relationship with the first nozzle exit hole diameter, and if the opening diameter is larger than 1.5 mm, ensuring a stable exhaust flow becomes difficult. If the third nozzle opening diameter is smaller than 1.0 mm, the exhaust flow from the second nozzle hole is not discharged stably, and if it is larger than 2.0 mm, it becomes difficult to collide with and disperse that exhaust flow using the second atomization/eddy flow formation compressed gas flow that is discharged from around it.

As described above, the inventive spray device for a small amount of liquid can easily and reliably control and adjust the dispensing amount of a small amount of liquid with low viscosity, does not require increasing or decreasing the needle stroke through a manual operation which requires skill as in prior art, and quantitative dispensed amount control can be performed with good reproducibility. Also, automated coating can be performed. Also, liquids such as liquid photoresist agents, surface protection films, functional coating agents, etc. can be widely and finely atomized without reducing coating efficiency, and it is possible to form a thin film on a coated object such as a semiconductor silicon wafer, glass substrate, various types of resins, metal members, etc.

DETAILED DESCRIPTION

Below, an embodiment of the present invention shall be described based on drawings.

Figure 1:
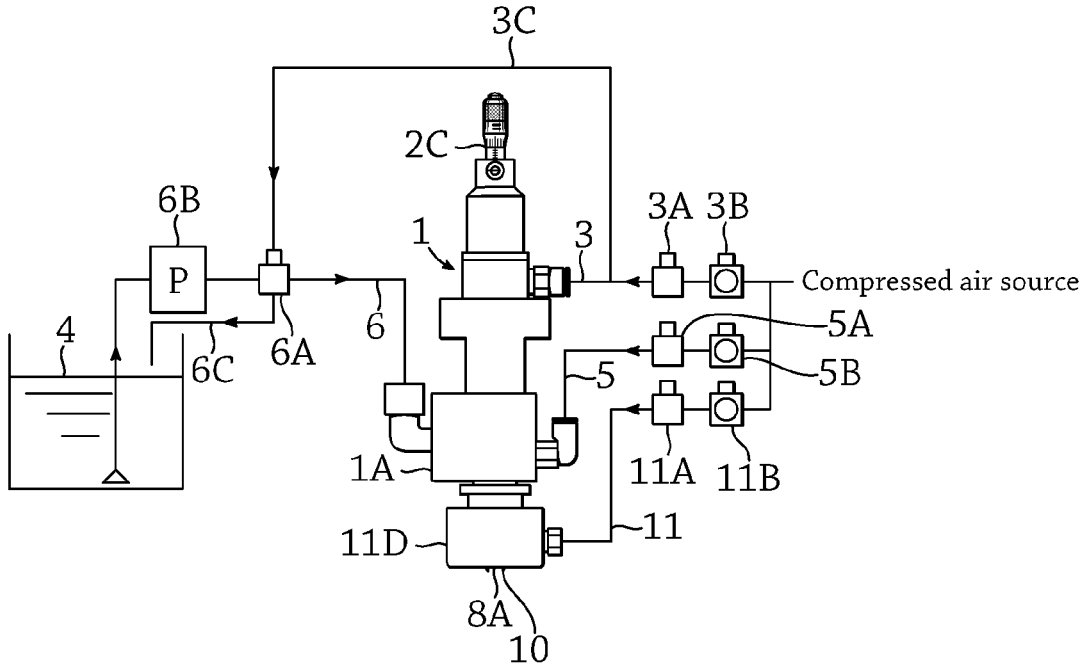
FIG. 1 is a view of the systems when using the inventive spray device for a small amount of liquid as a liquid automatic spray head for low dispensing amounts.
Figure 2:
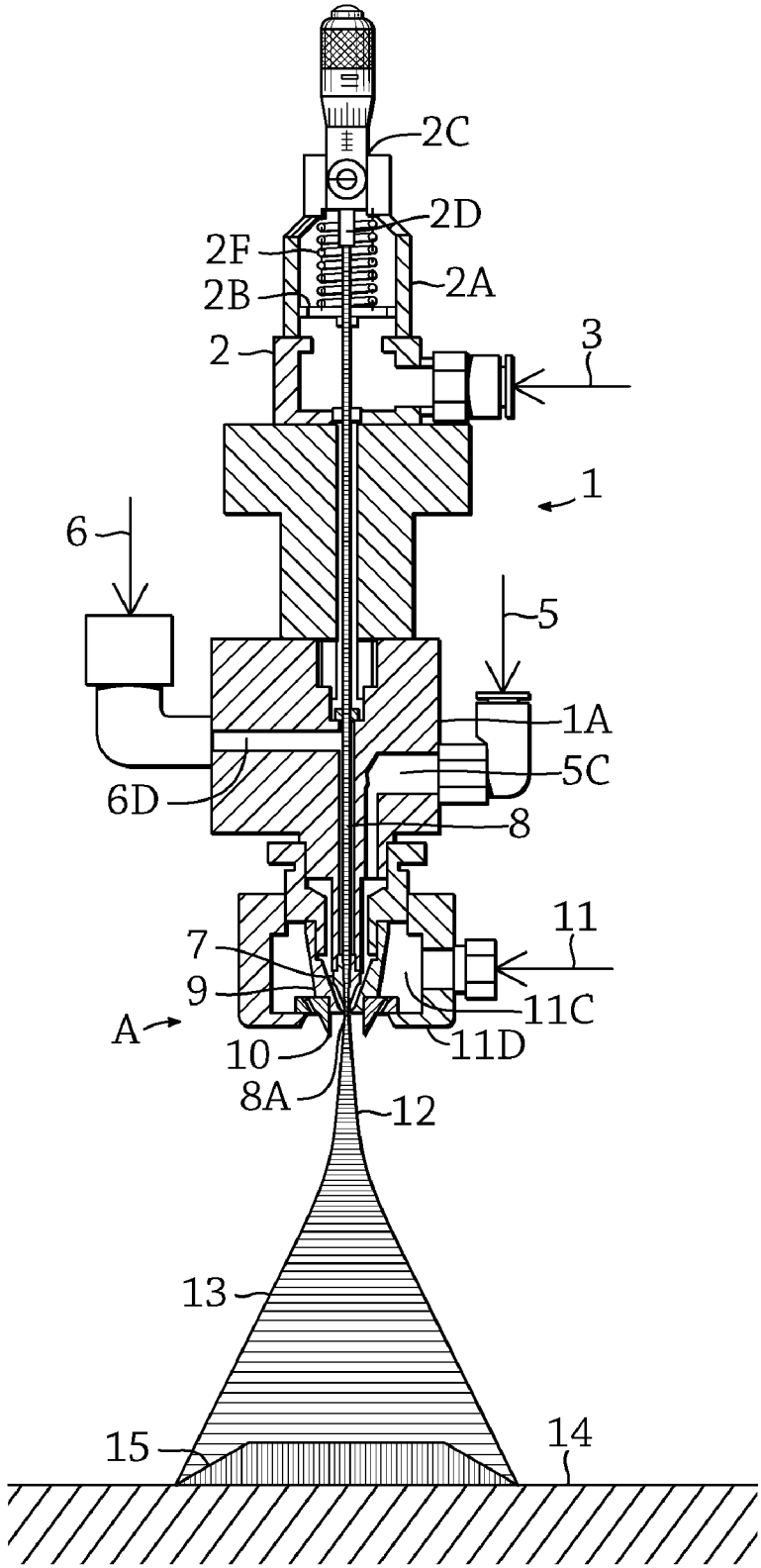
FIG. 2 is a vertical cross-section view of the inventive spray device for a small amount of liquid as a liquid automatic spray head for low dispensing amounts.
Figure 3:
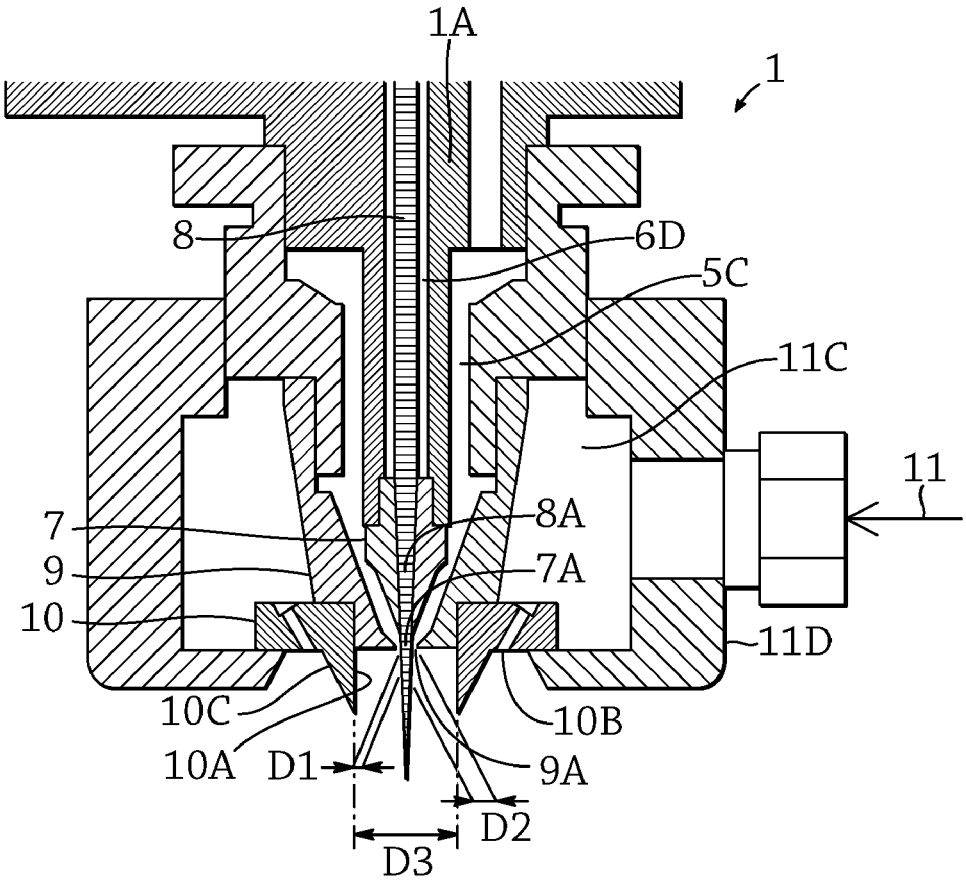
FIG. 3 is an enlarged view of part A in FIG. 2; an enlarged detail view of the first through third nozzles.
Figure 4:
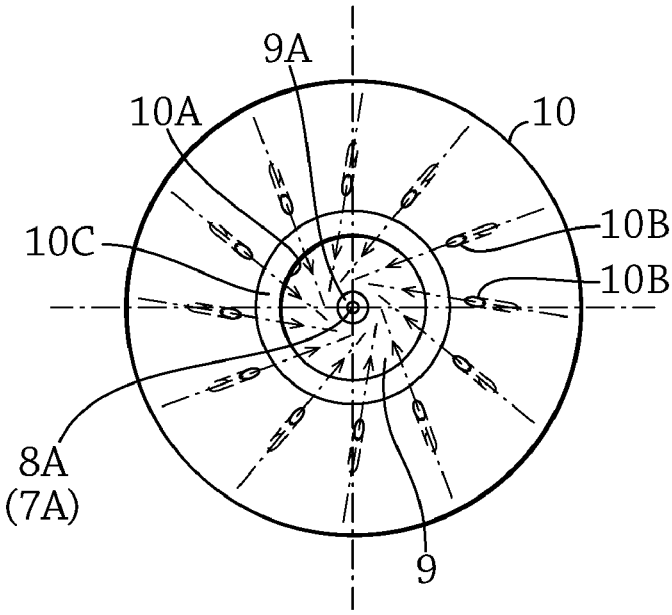
FIG. 4 is a bottom view of FIG. 3; a view of the bottom surface of the third nozzle.

FIG. 1 is a view of the systems when using the inventive spray device for a small amount of liquid as a liquid automatic spray head for low dispensing amounts. FIG. 2 is a vertical cross-section view of the inventive spray device for a small amount of liquid as a liquid automatic spray head for low dispensing amounts. FIG. 3 is an enlarged view of part A in FIG. 2, and is an enlarged detail view of the first through third nozzles. FIG. 4 is a bottom view of FIG. 3, and is a view of the bottom surface of the third nozzle.

Item 1 is a liquid spray head for low dispensing amounts; it has a liquid supply pipe 6 for quantitatively supplying a liquid stored in a liquid tank 4 using a quantitative supply pump 6B for supplying liquid. Also, interposed in the liquid supply pipe 6 is a liquid supply switching valve 6A, downstream from the quantitative supply pump 6B for supplying liquid. Also provided at the switching valve 6A is a liquid return pipe 6C for returning liquid to the liquid tank 4 when the liquid spray head 1 for low dispensing amounts is not operating to dispense liquid. Switching the liquid flow direction is such that when the operation of a head drive solenoid 3A halts, i.e. when a needle tip part 8A is pushed back to the first nozzle 7's first nozzle hole 7A by the elastic force of a spring 2F and the valve mechanism is closed, the liquid supply switching valve 6A operates and liquid switches from the liquid supply pipe 6 to the liquid return pipe 6C.

In addition, connected to the liquid spray head 1 for low dispensing amounts are a supply pipe 5 for first-stage atomization compressed air as the first atomization compressed gas and a supply pipe 11 for second-stage atomization compressed air as the second atomization/eddy flow formation compressed gas. The pressure of the compressed air can be adjusted by the respective atomization air regulators 5B and 11B. Also, the first-stage atomization compressed air flows to the liquid spray head 1 for low dispensing amounts due to the operation of a first-stage atomization solenoid 5A, and the second-stage atomization compressed air flows to it due to the operation of a second-stage atomization solenoid 11A. The operation sequence of the respective solenoids is usually that the first-stage atomization solenoid 5A operates, and after about 50 ms the head drive solenoid 3A and the second-stage atomization solenoid 11A operate essentially simultaneously; this is appropriate for optimal atomization of the liquid.

A needle body 8, which is long and extremely slender, is provided positioned in the center of the liquid spray head 1 for low dispensing amounts so that it can move vertically. An air piston 2B is fixedly provided at the upper end portion of the needle body 8. The spring 2F is interposed between the air piston 2B and an air piston cover 2A; it constantly presses the needle body 8 downward to close the valve mechanism constituted between the needle tip part 8A, whose tip part is needle-shaped and long and slender and tapering, and the first nozzle hole 7A of the first nozzle. A fluid supply passage 6D is formed between the needle body 8 and its surrounding head body 1A, and a first nozzle 7 is affixed at the lower end of the head body 1A. A first nozzle hole 7A, into which the needle tip part 8A can insertably fit, is formed in the first nozzle 7 with a tapered shape that corresponds to the shape of the needle tip part.

At the outside of the first nozzle 7 is the second nozzle 9, fixedly attached to the head body 1A to surround the periphery of the first nozzle 7 and form the ring-shaped first atomization compressed gas passage 5C, whose cross-section area with the first nozzle 7 becomes smaller going downward. A small-diameter second nozzle hole 9A is formed at the lower end of the second nozzle 9 and constricts around the periphery of the exit opening of the first nozzle hole 7A. That is, the inner wall face of the second nozzle 9 is formed in a reverse conical shape, with its lower end constricting to form the second nozzle hole 9A with small diameter D2. Also, a third nozzle 10 is fixedly attached to the lower end of the second nozzle 9; the third nozzle 10 is formed so that its exit opening surrounds the second nozzle hole 9A of the second nozzle 9.

Also, as shown in FIG. 4, a plurality of second atomization/eddy flow formation compressed air supply passages 10B are formed in the third nozzle 10. Seen in plan view, they are provided at equidistant spacing on the same circle centered on the central part of the first nozzle hole 7A and second nozzle hole 9A, i.e. centered on the axis of the needle-shaped needle tip part 8A, and they are provided penetrating at a slant when seen in front view. Also, the above-described third nozzle hole 10A is formed in the lower end part of the third nozzle 10, and projects by a predetermined distance beyond the lower face of the second nozzle hole 9; the outside wall of the third nozzle hole 10A is formed as a reverse conical shaped slanted face 10C. Because of this, the second atomization/eddy flow formation compressed air flow that is exhausted from the compressed air supply passages 10B flows along the slanted face 10C, and forms a stabilized eddy flow that is rectified at the entire periphery. This eddy flow collides with the exhaust flow exhausted from the third nozzle hole 10A, and forms a stabilized nonturbulent swirling exhaust flow. As a result, the exhaust flow is stable and wide and finely atomized.

Furthermore, the exhaust flow that is exhausted from the second nozzle hole 9A is not affected by the flow of the second atomization/eddy flow formation compressed air at the space inside the projection of the third nozzle hole 10A, so it exhausts stably toward the coated object below it, and the first-stage liquid atomization operation performed between the first nozzle 7 and second nozzle 9 is performed stably.

The third nozzle is attached to the head body 1A by a pusher nut 11D. The interior of the pusher nut 11D is formed in a box shape, and constitutes the second-stage atomization compressed air passage 11C between the second nozzle 9 and the outside of the third nozzle 10.

A micro-adjust 2C is attached to the upper end part of the liquid spray head 1 for low dispensing amounts as a needle movement amount adjustment device that can perform very tiny amount adjustments of the opening gap between the needle-shaped needle tip part 8A and the first nozzle hole 7A of the first nozzle 7. A micro-adjust end 2D is formed at the lower end of the micro-adjust 2C. Also, the micro-adjust end 2D is provided in such a manner that it can touch the rear end (upper end) of the needle body 8.

When a liquid with low viscosity (10-100 CPS) and a dispensed amount of 0.1-5.0 $cm^3$/min is made into tiny particles and applied, the exit opening diameter Dl of the first nozzle hole 7A of the first nozzle 7 is 0.2-0.6 mm ϕ, the angle of the needle-shaped needle tip part 8A is 3°-10°, the opening inner diameter D2 of the second nozzle hole 9A of the second nozzle 9 is 0.8-1.5 mm ϕ, the opening diameter D3 of the third nozzle hole 10A of the third nozzle 10 is 1.0-2.0 mm ϕ, and the movement distance of the needle for performing very tiny amount adjustments of the opening gap between the needle-shaped needle tip part 8A and the first nozzle hole 7A by the micro-adjust 2C can be adjusted to each 8-15 μm.

Constituted in this manner, the liquid spray head 1 for low dispensing amounts operates as follows: when the head drive solenoid 3A operates, compressed air flows from a head drive compressed air pipe 3 to inside the valve air piston 2, and the air piston 2B works on the micro-adjust 2C side against the elastic force of the spring 2F. The rear end part of the needle body 8, which is linked to the air piston 2B, projects and touches the micro-adjust end 2D, and the stroke of the needle body 8 is halted at a set position, and the gap between the first nozzle hole 7A and the needle tip part 8A is kept at a predetermined separation.

Then the needle tip part 8A of the needle body 8 moves away from the first nozzle hole 7A and forms a tiny gap with the first nozzle hole 7A, and the liquid that is in the liquid supply passage 6D inside the head is pressed out from the interior of the first nozzle hole 7A onto the surface of the needle tip part 8A by pressure transmitted by the liquid supply quantitative supply pump 6B; at the same time, the liquid on the surface of the needle tip part 8A is suctioned and pulled out from the exit (lower end) opening of the first nozzle hole 7A by the ejector effect of the first-stage atomization compressed air flowing from the first-stage atomization compressed air supply passage 5C inside the head. The liquid pulled out of the exit opening part of the first nozzle hole 7A is simultaneously atomized by the first-stage atomization compressed air, i.e. is made into tiny particles, and passes through the second nozzle hole 9A of the second nozzle 9 and is sent to inside the third nozzle hole 10A of the third nozzle 10 as an exhaust flow. Here, a first-stage atomization pattern 12 is formed.

Then, the first-stage atomization pattern 12, which is an exhaust flow of tiny liquid particles formed by atomization, is made into even smaller particles by the ejector effect of second-stage atomization compressed air flowing from the second atomization/eddy flow formation compressed air supply passages 10B of the third nozzle 10 via the second-stage atomization compressed air supply passage 11C, and is swirled to form a swirling flow, and a second-stage atomization pattern 13 with an eddy-like pattern is formed, and adheres to and coats a coated object 14.

In the present invention, suitable liquids used as coating agents are a liquid photoresist agent, surface protection film, and functional coating agent. A semiconductor silicon wafer, glass substrate, various types of resins, metal members, etc. are suitable as the coated object.

As described above, in the present embodiment, given that the first nozzle 7 with the first nozzle hole 7A had an exit opening diameter of 0.2-0.6 mm ϕ, the needle tip part 8A, which played the role of the valve controlling liquid dispensing, was structured to have an acute angle of 3°-10°, and extended to the first nozzle hole 7A of the first nozzle 7 and the second nozzle hole 9A of the second nozzle 9, and extended farther to the nozzle hole 10A of the third nozzle 10. It was decided to perform air atomization with a structure whereby the aperture was adjustable in units of 8-15 μm by the needle stroke length when dispensing liquid. Attaching a micro-adjust 2D that could adjust the stroke of the needle 8 in units of 8-15 μm ensured reproducibility of the amount dispensed each time the valve opened and closed, and produced stable dispensing.

When the dispensed liquid oozes out along the extremely slender needle tip part 8A, the liquid is atomized by the negative pressure effect of the surrounding first-stage atomization compressed air flow at pressure 0.1-0.3 MPa, and is exhausted from the 0.8-1 .5 mm ϕ second nozzle hole 9A of the second dispensing nozzle 9, and collides with and is dispersed by the second-stage atomization/eddy compressed air flow at pressure 0.1-0.3 MPa from the aperture 1.0-2.0 mm ϕ third nozzle hole 10A of the third nozzle 10, thereby promoting making the liquid into even tinier particles and dispersing the atomization pattern region.

That is, in the present embodiment, the spray head 1, which sprays and dispenses a small amount of liquid, can efficiently apply and adhere a liquid with law viscosity, 10-100 CPS, in a spray pattern 15 that has a trapezoidal distribution of the full spray, with the projecting acute-angle needle tip part 8A controlling liquid dispensing at the first through third dispensing nozzles 7, 9, and 10.

That is, the liquid spray head 1 for low dispensing amounts of the present embodiment is characterized in that it has the acute-angle needle tip part 8A, which has an angle of 3°-10° for controlling liquid dispensing of a liquid with low viscosity (10-100 CPS) at the first nozzle 7, which has a first nozzle hole 7A with an exit aperture of 0.2-0.6 mm ϕ, and the needle tip part 8A projects to the first nozzle hole 7A, second nozzle hole 9A, and third nozzle hole 10A. When the dispensed liquid oozes out along the needle tip part 8A, the liquid is sprayed by the negative pressure effect of the air flow of the surrounding first-stage atomization compressed air at pressure 0.1-0.3 Mpa, and is exhausted from the 0.8-1.5 mm ϕ second nozzle hole 9A of the second dispensing nozzle 9, and collides with and is dispersed by the eddy-like air flow of second-stage atomization/eddy compressed air at pressure 0.1-0.3 Mpa from the aperture 1.0-2.0 mm ϕ third nozzle 10, thereby making the liquid into tiny particles and dispersing the promoted atomization region, and by having the micro-adjust 2D, which is able to control the movement distance of the needle part 8 provided at the head's rear part in units of 8-15 μm, it became possible to dispense small amounts of low-viscosity liquid by making very tiny adjustments of the gap between the first nozzle 7 and the needle tip part 8A.

In this way, the present embodiment makes it possible to provide a liquid automatic spray head (spray gun) 1 for low dispensing amounts that can widely and finely atomize a liquid without reducing coating efficiency, and that can form a thin film of 0.1-10 μm, for example.

Also, in the automatic spray head 1 of the present embodiment, when atomizing and applying a liquid resist agent to a coated object which has a stepped pattern, such as a semiconductor silicon wafer, the particles are made very fine, and solvent evaporates and increases the liquid viscosity, which minimizes the coating film sagging downward even at the raised part of the stepped area or at corners (edges) in recesses, and it is possible to form a film with the desired thickness, such as 6-10 μm, and it is possible to apply a film which is uniform overall.

The flow rate distribution 15 of the second-stage atomization pattern 13 when the above-described eddy-like pattern's second-stage atomization pattern 13 is formed and adhered and applied to the coated object 14 is a flat trapezoidal distribution that is essentially two out of three parts (2/3) of the entire pattern. This atomization pattern flow rate distribution 15 is changed by the first-stage atomization compressed air supply pressure and the second-stage atomization compressed air supply pressure (or flow rate). When both atomization compressed air pressures are essentially identical, a flat trapezoidal distribution is obtained, but when the second-stage atomization compressed air supply pressure is one-half or less of the first-stage atomization compressed air supply pressure, that changes.

Next, the results of measurement experiments shall be described.

Figure 5:
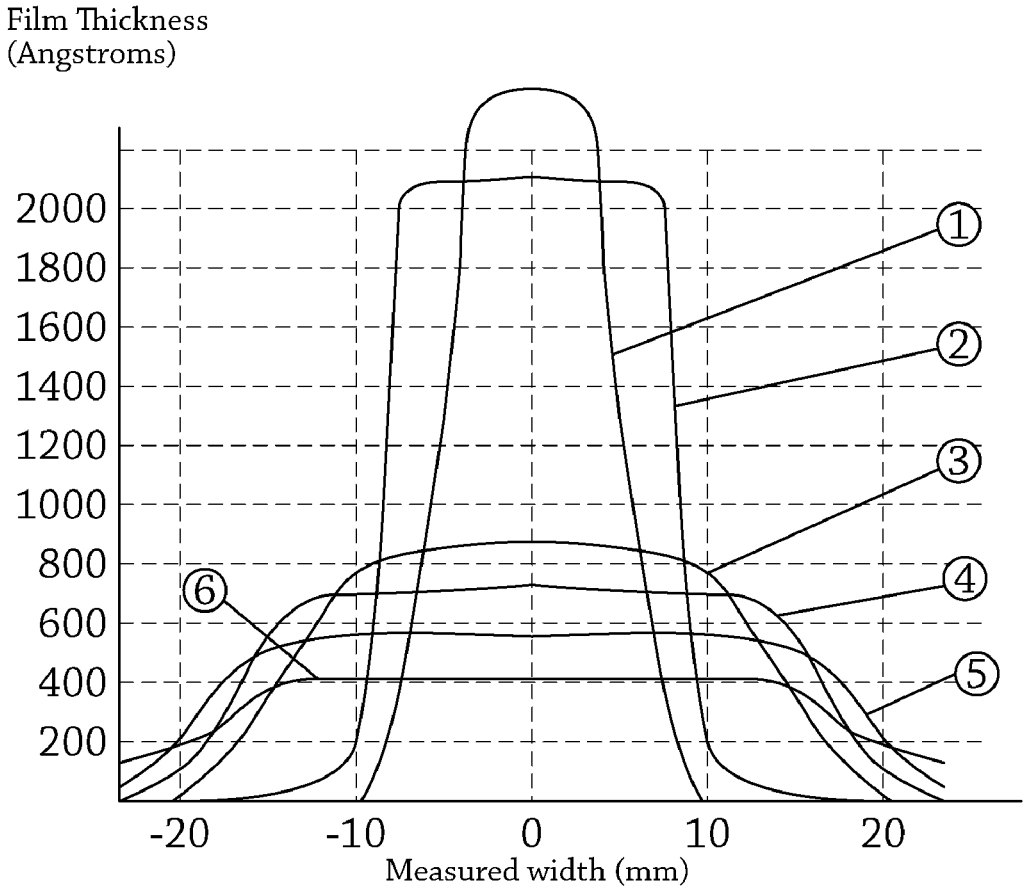
FIG. 5 is a graph showing the result of measuring the coating pattern; a graph showing the relationship between coating width and film thickness.

FIG. 5 represents the pattern flow rate distribution of the result of measuring film thickness when the liquid spray head 1 for low dispensing amounts was moved along a single straight line. As can be seen in FIG. 5, when the first-stage atomization compressed air pressure and the second-stage atomization compressed air pressure, which were coating parameters (3) and (4), were 0.1 MPa to 0.15 MPa respectively, the atomization pattern's flow rate distribution 15 was a flat trapezoidal distribution that was essentially 2/3 of the entire pattern. When the second-stage atomization compressed air pressure was increased, the pattern width had a tendency to widen, and the film thickness decreased below the expected number. This appeared to be because the coating efficiency decreased. Not increasing the second-stage atomization compressed air pressure very much maintained coating efficiency and produced a relatively stable trapezoidal distribution. When coating efficiency was measured, (1) was 88%, (2) was 86%, (3) was 82%, (4) was 79%, and (5) and (6) were 76% or less.

Figure 6:
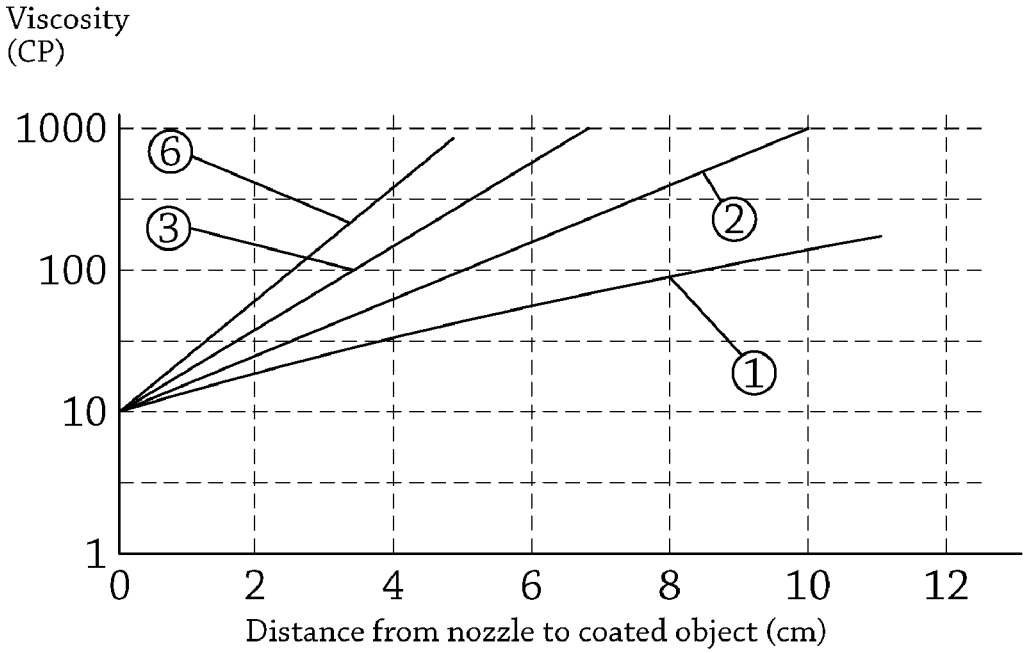
FIG. 6 is a graph showing the result of measuring viscosity increase after spraying a liquid; a graph showing the relationship between viscosity and the distance from the nozzle to the coated object.

FIG. 6 shows measurements of the increase in liquid viscosity after spraying at the respective distances from the nozzle to the coated surface under coating parameters (1), (2), (3), and (6). When the atomization compressed air pressure was raised, the amount of air also increased, and the viscosity of the atomized liquid had a tendency to increase. This was because the solvent evaporated more and the solid component increased. Parameters (3) and (6) in particular mean that the applied film was resistant to sagging after spraying.

Measurement 1

Measurement of the atomization pattern flow rate distribution 15.

(1) The liquid viscosity was set at 20 CPS.

That is, the starting solution AZ P4330 (NV value 30%) was diluted with solvent to a weight ratio of 1, and propylene glycol monomethyl ether acetate was added to a weight ratio of 1, producing a liquid with viscosity 20 CPS and solid component ratio 15% (volume NV value 0.11%).

(2) Liquid's specific gravity: 1.33.

(3) The liquid supply quantitative pump 6*b* was a gear pump, dispensing 1.5 cc/minute at liquid pressure 0.01 MPa.

(4) Distance between nozzle and coated object: 40 mm.

(5) The first-stage atomization compressed air pressure was varied from 0.1 MPa to 0.25 MPa.

(6) The second-stage atomization compressed air pressure was varied from 0.02 MPa to 0.25 MPa.

(7) The speed when moving the liquid spray head 1 for low dispensing amounts along a single straight line was 900 mm/minute.

(8) Film thickness was measured when moving the liquid spray head 1 for low dispensing amounts along a single straight line.

The film thickness measurements when doing so are shown in FIG. 5; FIG. 6 shows measurements of the viscosity increase after spraying the liquid. The coating parameters of (1)-(6) in FIG. 5 are shown in the Table 1.

TABLE 1

| No | First-stage atomization compressed air pressure (MPa) | Second-stage atomization compressed air pressure (MPa) |
|---|---|---|
| (1) | 0.25 | 0.02 |
| (2) | 0.20 | 0.10 |
| (3) | 0.15 | 0.10 |
| (4) | 0.10 | 0.10 |
| (5) | 0.10 | 0.15 |
| (6) | 0.08 | 0.18 |

Based on the above parameters, the liquid spray head 1 for low dispensing amounts was mounted on an orthogonal-type manipulator operating on the X and Y axes and in the Z axis direction. The results of applying and forming a thin film on a flat coated object are described below.

(1) Liquid Spray Head for Low Dispensing Amounts

The smaller the hole diameter in the first nozzle 7 for dispensing the coating material (liquid), the more the dispensed flow amount was constricted. What was more effective in this experiment was a small-diameter first nozzle 7 in which the exit opening diameter D1 of the first nozzle hole 7A was 0.3 mm 100 and the needle 8 was a needle-shaped tapered needle with a slant of 5° from the tip. The liquid spray head for low dispensing amounts was mounted on an orthogonal-type manipulator operating on the X and Y axes and in the Z axis direction, and a method was used in which both ends of the spray pattern were applied by lapping.

(2) Coating Material

The optimal result for a liquid resist agent was when the starting solution AZ P4330 (NV value 30%) made by Client Japan (Inc.) was diluted with solvent to a weight ratio of 1, and propylene glycol monomethyl ether acetate was added to a weight ratio of 1, producing a solid component ratio of 15% and viscosity 20 CPS. Results were also good at the other viscosities of 30-50 CPS.

(3) Dispensing Liquid Pressure 0.015 MPa (4) Application Room Temperature and Relative Humidity

20° C. 65%

(5) Coated Object

A flat glass plate, 200 mm square,

And a 6-inch wafer bearing a stepped-area pattern with width 25 μm and height 50 μm.

(6) Target Coating Film Thickness

Within 3 μm±5% (3 σ) relative to the flat glass surface.

The target was 6 μm to 10 82 m at each face and the corners of the 6-inch wafer bearing a stepped-area pattern.

(7) Other Coating Parameters

| | |
|---|---|
| Nozzle movement speed (X axis) | 300 mm/min |
| Distance between nozzle and coated object | 40 mm |
| Dispensed amount | 1.5 cc/min |
| Number of applications | 1 |
| Surface temperature when coating the coated object | 30° C. |
| First-stage atomization compressed air pressure hereinafter "atomization air pressure") | 0.15 MPa |
| Second-stage atomization compressed air pressure (hereinafter "pattern air pressure") | 0.1 MPa |
| Coating pitch | 10 mm |
| Drawing parameters after coating | 100° C. |
| Drying time | 3 minutes |

The result of experiments using the above basic parameters was that the desired good coating state was obtained. Table 2 shows the results for that coating state.

TABLE 2

| Coating position | 1 | 2 | 3 | 4 | 5 | 6 |
|---|---|---|---|---|---|---|
| Hot plate set temperature: 30° C. Number of applications: 1 | | | | | | |
| First batch film thickness (Angstroms) | | | | | | |
| Top | 30011 | 30015 | 30022 | 30014 | 30023 | 30022 |
| Middle | 30028 | 30038 | 30010 | 30025 | 30002 | 30008 |
| Bottom | 30010 | 30007 | 30021 | 30105 | 30020 | 30024 |
| Left | 30021 | 30026 | 30021 | 30028 | 30012 | 30042 |
| Right | 30021 | 30007 | 30023 | 30081 | 30034 | 30018 |
| Second batch film thickness (Angstroms) | | | | | | |
| Top | 30810 | 30025 | 30029 | 30023 | 30022 | 30022 |
| Middle | 30051 | 30179 | 30030 | 30212 | 30152 | 30201 |
| Bottom | 30029 | 30029 | 30021 | 30021 | 30026 | 30113 |
| Left | 30114 | 30026 | 30029 | 30034 | 30208 | 30021 |
| Right | 30025 | 30017 | 30022 | 30029 | 30030 | 30040 |
| Third batch film thickness (Angstroms) | | | | | | |
| Top | 30021 | 30020 | 30061 | 30016 | 30052 | 30018 |
| Middle | 30022 | 30044 | 30022 | 30015 | 30045 | 30058 |
| Bottom | 30013 | 30093 | 30096 | 30040 | 30093 | 30050 |
| Left | 30020 | 30015 | 30020 | 30083 | 30052 | 30016 |
| Right | 30166 | 30055 | 30024 | 30018 | 30076 | 30020 |

The target value for the above data was a film thickness of 30,000 (Angstroms), precision 5%.

The amount used for coating a flat glass plate, 200 square, was 3 cc. In this case, if the target precision was 5%,

USL=31,500, LSL=28,500, UCL=30,330, LCL=29,773, # of excp.=0.0, # of samp=96, mean film thickness=30051.5,

Min film thickness=30,002, Max film thickness=30,810,

Diff.=0.17%, Cp=5.391, Cpk=5.206, Stdev.=92.8,

3Sigma=278.3, 3 Sigma %=0.93%.

Figure 7:
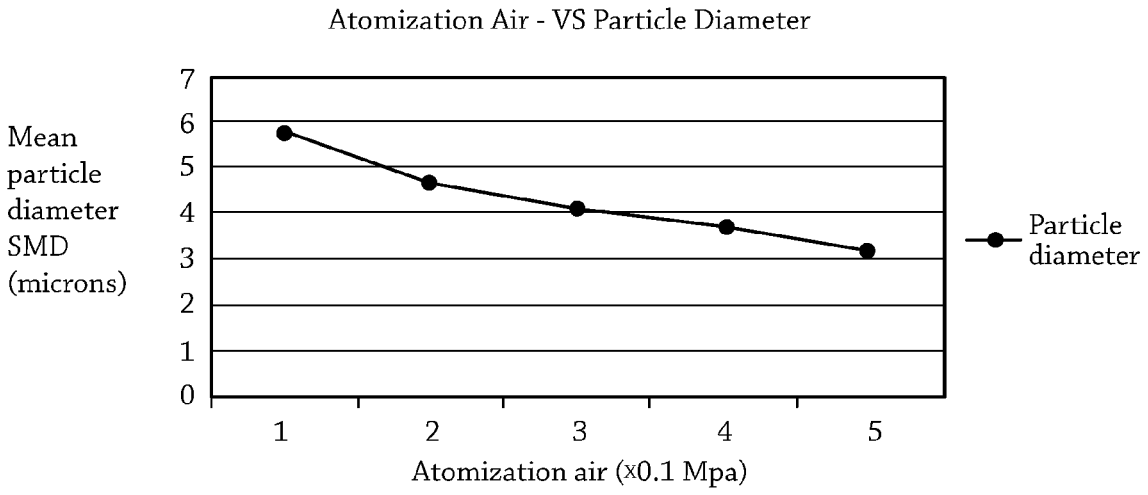
FIG. 7 is a graph showing the result of measuring particle diameter distribution under the coating parameters for first-stage atomization compressed air pressure and second-stage atomization compressed air pressure in (1) in Table 1.

The particle diameter distribution measurement results are shown in FIG. 7.

The present invention is not limited to the above embodiment, and can be practiced in various other configurations without deviating from its features. Therefore, the above-described embodiment is merely an example of each point, and is not to be interpreted as limiting. The scope of the present invention is indicated by the claims, and is not restricted whatsoever by the specification text. In addition, variations and modifications belonging to the same scope as the patent claims are all within the scope of the present invention.

What is claimed is:

1. A spray device for making a small amount of liquid into tiny particles and applying the particles to an object, comprising:

a liquid supply passage, a needle defining a needle axis and including a rear end and a tip part, said tip part being needle-shaped and long and slender and tapering at an angle from the needle axis, a first nozzle which constitutes a valve mechanism with said tip part of said needle, said first nozzle including a first nozzle hole having a shape that corresponds to said tip part, said tip part being insertable fit into said first nozzle hole, and said first nozzle hole and said tip part adapted to define an opening gap, a second nozzle which surrounds said first nozzle and forms a ring-shaped first atomization compressed gas passage with the first nozzle, said second nozzle including a lower end and a second nozzle hole formed at the lower end, a third nozzle, disposed at the lower end of said second nozzle, and including a third nozzle hole having a periphery and surrounding the second nozzle hole of said second nozzle, and further including a plurality of compressed gas supply passages for second atomization/eddy flow formation formed at the periphery of said third nozzle hole, and a needle movement amount adjustment device operative to contact the rear end of said needle, and capable of making size adjustments of the opening gap of said tip part of said needle and the first nozzle hole of said first nozzle;

wherein when dispensing liquid, liquid oozes from the first nozzle hole of the first nozzle along the tip part, and the liquid is made into tiny particles by compressed gas flowing through said first atomization compressed gas passage and is discharged from the second nozzle hole of the second nozzle as an exhaust flow, and then said exhaust flow passes through the third nozzle hole of the third nozzle and collides with compressed gas flowing through the plurality of compressed gas supply passages in said third nozzle, so that said exhaust flow is made into even smaller particles, swirls and disperses, and is applied to the object.

2. The spray device of claim 1, wherein the tip part of the needle projects to the third nozzle hole of the third nozzle when the valve mechanism is open.

3. The spray device claim 1, wherein the liquid supplied to said liquid supply passage has a viscosity of 10-100 CPS and flows at a flow rate of 0.1-10 $cm^{3/}$ min, the first nozzle hole of said first nozzle includes an exit opening diameter of 0.2-0.6 mm, the angle of said needle-shaped needle tip part from the needle axis is 3°-10°, the second nozzle hole of said second nozzle includes an opening inner diameter of 0.8-1 .5 mm, the third nozzle hole of said third nozzle includes an opening diameter of 1.0-2.0 mm, and the needle movement amount adjustment device makes size adjustments of the opening gap of 8-15 μ(microns).

* * * * *

UNITED STATES PATENT AND TRADEMARK OFFICE

CERTIFICATE OF CORRECTION

PATENT NO. : 7,681,808 B2
APPLICATION NO. : 12/177429
DATED : March 23, 2010
INVENTOR(S) : Takaji Shimada It is certified that error appears in the above-identified patent and that said Letters Patent is hereby corrected as shown below:

Column 11

Line 7, change "10 82 m" to --10 μm--.

Table 2, line 36, change "30023" to --30028--.

Table 2, line 48, change "30093" to --30053--. (1st occurrence)

Claim 1, line 11, delete "fit".

Signed and Sealed this

Thirty-first Day of August, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,681,808 B2
APPLICATION NO. : 12/177429
DATED : March 23, 2010
INVENTOR(S) : Takaji Shimada It is certified that error appears in the above-identified patent and that said Letters Patent is hereby corrected as shown below:

Column 11

Line 7, change "10 82 m" to --10 μm--.

Table 2, line 36, change "30023" to --30028--.

Table 2, line 48, change "30093" to --30053--. (1st occurrence)

Column 12, line 20 (Claim 1, line 11), delete "fit".

This certificate supersedes the Certificate of Correction issued August 31, 2010.

Signed and Sealed this

Twenty-eighth Day of September, 2010

David J. Kappos

David J. Kappos
*Director of the United States Patent and Trademark Office*